US008591256B2

(12) United States Patent
Kobayashi et al.

(10) Patent No.: US 8,591,256 B2
(45) Date of Patent: Nov. 26, 2013

(54) WIRE-TO-BOARD CONNECTOR AND WIRE CONNECTOR

(75) Inventors: Kotaro Kobayashi, Fujisawa (JP); Shigeru Akiyama, Machida (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 13/321,451

(22) PCT Filed: May 20, 2010

(86) PCT No.: PCT/US2010/035617

§ 371 (c)(1), (2), (4) Date: Nov. 18, 2011

(87) PCT Pub. No.: WO2010/135556

PCT Pub. Date: Nov. 25, 2010

(65) Prior Publication Data

US 2012/0077365 A1 Mar. 29, 2012

(30) Foreign Application Priority Data

May 20, 2009 (JP) ..... 2009-122026

(51) Int. Cl.
*H01R 13/40* (2006.01)

(52) U.S. Cl.
USPC ..... 439/595

(58) Field of Classification Search
USPC ..... 439/595, 752
See application file for complete search history.

(56) References Cited

U.S. PATENT DOCUMENTS

| | | | | |
|---|---|---|---|---|
| 5,108,318 | A * | 4/1992 | Sakurai et al. | 439/744 |
| 5,554,052 | A * | 9/1996 | Saijo et al. | 439/595 |
| 5,913,697 | A * | 6/1999 | Myer et al. | 439/595 |
| 6,796,837 | B2 * | 9/2004 | Fukatsu et al. | 439/595 |
| 6,948,986 | B2 * | 9/2005 | Kojima et al. | 439/752 |
| 7,094,101 | B1 * | 8/2006 | Noro et al. | 439/595 |
| 7,118,424 | B2 | 10/2006 | Masaki et al. | |
| 7,396,255 | B2 * | 7/2008 | Morello et al. | 439/595 |
| 7,517,247 | B2 * | 4/2009 | Hiramatsu | 439/595 |
| 2005/0032424 | A1 * | 2/2005 | Ichida et al. | 439/595 |
| 2005/0037653 | A1 | 2/2005 | Comerci | |
| 2005/0085127 | A1 * | 4/2005 | Maeda | 439/595 |
| 2005/0250385 | A1 * | 11/2005 | Tsuji | 439/595 |
| 2009/0186524 | A1 * | 7/2009 | Maesoba et al. | 439/595 |

FOREIGN PATENT DOCUMENTS

| | | |
|---|---|---|
| JP | 2004-055233 | 2/2004 |
| WO | WO 2007/110699 A2 | 10/2007 |

OTHER PUBLICATIONS

International Search Report for PCT/US2010/035617.

* cited by examiner

*Primary Examiner* — Gary F. Paumen

(74) *Attorney, Agent, or Firm* — Timothy M. Morella

(57) ABSTRACT

A wire to board connector assembly includes mating first and second connectors. The board (second) connector is configured for surface mounting to a circuit board and contains a plurality of surface mount terminals with a pair of contact arms defining a mating slot therebetween. The other, mating (first) connector includes a plurality of box-style terminals that are supported and restrained in place within a first connector housing. Projections are dispose in the first connector housing and extend lengthwise along the direction of the terminals and provide support for the terminals. Locking members are formed as part of the first housing and reliably engage the second housing.

19 Claims, 16 Drawing Sheets

FIG. 8A
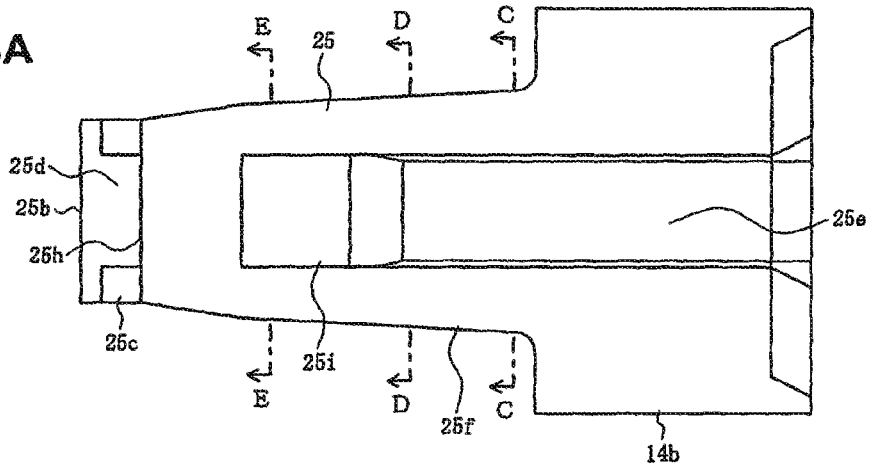
FIG. 8B
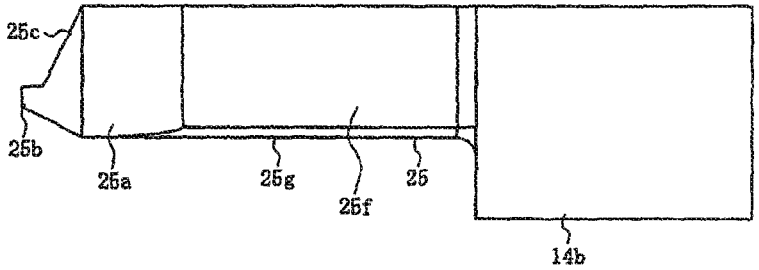
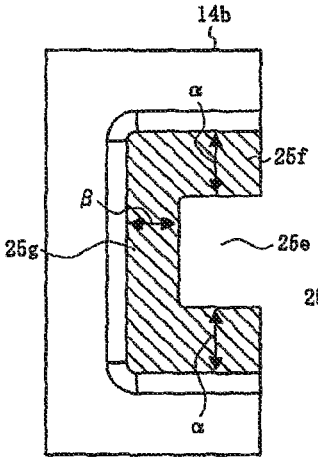
FIG. 8C
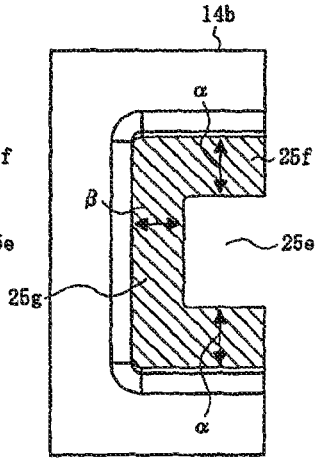
FIG. 8D
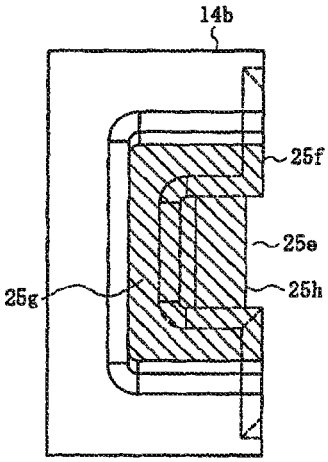
FIG. 8E

WIRE-TO-BOARD CONNECTOR AND WIRE CONNECTOR

REFERENCE TO RELATED APPLICATIONS

The Present Disclosure claims priority to prior-filed Japanese Patent Application No. 2009-122026, entitled "Wire-To-Board Connector And Wire Connector," and filed 20 May 2009, the contents of which is fully incorporated in its entirety herein.

BACKGROUND OF THE PRESENT DISCLOSURE

The Present Disclosure relates generally to a wire-to-board connector and a wire connector, and more specifically to such a connector assembly having a low height and reliable locking structure.

Previously, wire-to-board connectors have been used for connecting electrical wires of a cable to a circuit board such as described in Japanese Patent Application No. 2007-220422. Such a wire-to-board connector has a board connector mounted on the circuit board and engaged by fitting with a wire connector which is connected to an end portion of an electrical wire.

FIG. 16 is an exploded perspective view of a wire connector according to the prior art, in which a wire connector 801 is engaged by a board connector (not shown). A terminal 851 is connected to a termination end of an electrical wire 891 and attached to a housing 811 of the wire connector 801. The housing 811 is formed with a terminal-insertion hole 814, and the terminal 851 is press-fit into the terminal-insertion hole 814. In this way, by fitting the wire connector 801 having the terminal 851 attached thereto so as to be engaged with the board connector, the wire 891 can be connected to a circuit board on which the board connector is mounted, also not shown. Moreover, a locking projection 816 is formed on the housing 811, and this projection 816 is engages a locking portion of the board connector, whereby a stable engagement state can be maintained.

However, in the above-described conventional wire-to-board connector, when the wire 891 is pulled with a strong force when the wire connector 801 and board connector are tightly engaged, there may occur an unfavorable occurrence of the terminal 851 coming loose and pulled from the terminal-insertion hole 814. In order to prevent the removal of the terminal 851, it may be helpful to form a locking projection, called a lance, on an inner wall of the terminal-insertion hole 814 so that the terminal 851 is locked at the latching projection. However, in recent years, connectors have become miniaturized along with the miniaturization of electronic components, devices, and apparatuses. Therefore, the locking projection also has to be extremely small, and moreover, there is a concern that the locking projection itself may be broken when the electrical wire 891 is pulled with a strong force.

The housing 811 which is made of resin is molded, for example, by a molding method that causes molten resin to flow into a mold, like an injection molding. Therefore, the locking projection projected from the inner wall of the terminal-insertion hole 814 is positioned at the inner side of the housing 811, and is thus distant from a gate portion, which is the entrance port of the molten resin into the mold, and is the end point of the flow of the molten resin. For this reason, in such a locking projection, weld lines (sometimes, referred to simply as "welds") are likely to occur at the converging positions of the flows of the molten resin. In particular, since locking projections are very small and thin, the weld lines are likely to extend in a direction of crossing a cross section thereof.

Moreover, since the weld lines represent interfaces formed because two or more flows of molten resin are unable to reunite, the strength thereof is low. Therefore, when a strong force that pulls the wire 891 is applied to the locking projection via the terminal 851, the locking projection will easily brake at the weld lines. Particularly, when the weld lines are formed at the base end of the locking projection and the vicinity thereof, substantially the entire portions of the locking projection will be lost by the breakage, and thus, the terminal 851 will be removed and extracted from the terminal-insertion hole 814.

It is difficult to prevent the occurrence of the weld lines, and also difficult to control the locations or the extending directions of the weld lines. Particularly, in recent years, the wire connector 801 has been miniaturized and the respective parts of the housing 811 have been made thinner along with the miniaturization of electronic devices and apparatuses. Therefore, it is extremely difficult to control the flow of molten resin so as to prevent the occurrence of weld lines in the locking projection.

SUMMARY OF THE PRESENT DISCLOSURE

Therefore, it is an object of the present invention to solve the above-described problems and provide a wire-to-board connector and wire connector having a configuration such that a locking projection portion has an appropriate shape for enabling the prevention of the occurrence of weld lines at the base end of the locking projection portion or the vicinity thereof. As a result, it is possible to more stably hold the terminal secured to the housing while reliably preventing the removal of the terminal, thereby realizing a simple structure with low height so that the miniaturization of a wire-to-board connector and wire connector is effected. Accordingly, the wire-to-board and wire connector allow easy production with a simple structure and high reliability in operation with a small number of parts and low production costs.

Therefore, a wire-to-board connector according to the present invention includes a first connector having a first insulative housing and a first terminal connected to a termination end of a wire fitted in the first housing, where the first connector has a fitting face extending in a direction intersecting an extending direction of the first terminal; and a second connector having a second insulative housing and second terminal fitted in the second housing and configured to contact with the first terminal, with the second connector configured for surface-mounting to a circuit board and for engaging with the first connector and having a fitting face intersecting the top surface of the board, wherein: the first housing is provided with a first terminal receiving concave portion configured to be opened to a rear end face opposing the fitting face and a locking projection portion which is arranged in the first terminal accommodation-concave portion and is formed therein with a groove portion extended in the direction of the first terminal; and, the first terminal is provided with a first contacting distal end portion configured to make contact with the second terminal and a locking piece which is formed on the first contacting distal end portion and configured to be locked at a front end face of the locking projection portion, where the first terminal is inserted to be fitted into the first terminal accommodation-concave portion from the side of the rear end face.

The wire-to-board connector according to another embodiment has a configuration such that the locking projection portion has a base end thereof which is connected to a first body portion of the first housing and extended in the direction of the fitting face, and has a distal end thereof having a locking block portion formed thereon, and the groove portion being formed on a surface of the locking projection portion located further rearward than the locking block portion, where the locking projection portion has a channel shape having a cross-section in the form of substantially squared U-shape.

The wire-to-board connector according to a further embodiment has a configuration such that the groove is extended to pass through the first body portion and opened to the rear end face. The wire-to-board connector according to a still further embodiment has a configuration such that the locking projection portion is provided with a ceiling portion and side portions on both left and right sides thereof, where the ceiling and side portions define circumferential surfaces of the groove portion, and the thickness dimension of each side portion is equal to or larger than the thickness dimension of the ceiling portion.

The wire-to-board connector according to a still further embodiment has a configuration such that a sloped portion is formed on portions of the groove portion connected to the locking block portion so that a cross-sectional area of the sloped portion increases gradually from the groove portion to the locking block portion. Moreover, a wire connector according to the disclosure includes an insulative housing and a terminal connected to a wire termination end fitted in the housing, where the wire connector has a fitting face extending in a direction intersecting the extent of the terminal, wherein: the housing is provided with a terminal-receiving, concave cavity configured to open to a rear end face opposing the fitting face, and a locking projection portion which is arranged in the terminal cavity and which is formed with a groove portion extending in the direction of the terminal; and, the terminal is provided with a contacting distal end portion configured to contact with a counterpart terminal of a mating connector, and a locking piece which is formed on the contacting distal end portion and configured to be locked at a front end face of the locking projection portion, where the terminal is inserted to be fitted into the terminal cavity from the side of the rear end face.

The wire connector according to another embodiment has a configuration such that the locking projection portion has a base end thereof which is connected to a housing body portion and extends in the direction of the fitting face and further has a distal end thereof having a locking block portion formed thereon, and the groove portion being formed on a surface of the locking projection portion further rearward than the locking block portion, wherein the locking projection portion has a channel shape having a cross-section in the form of substantially squared U-shape.

In accordance with the present invention, the wire-to-board and wire connector have a configuration in which the locking projection portion has an appropriate shape to enable the prevention of the occurrence of weld lines at the base end of the locking projection portion or the vicinity thereof. Due to such a configuration, the terminal is firmly secured in the housing while the removal thereof is reliably prevented, thereby providing a simple low height structure. Accordingly, it is possible to provide a wire-to-board connector and a wire connector which can be easily produced to have a simple structure with a small number of parts and low production costs.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which:

FIGS. 8A-8B are views of the locking projection of FIG. 7;

FIGS. 8C-8E are cross-sectional views of the locking projection of FIG. 8A, taken along Lines C-C, D-D and E-E, respectively, thereof;

DESCRIPTION OF THE PREFERRED EMBODIMENTS

Figure 1A:
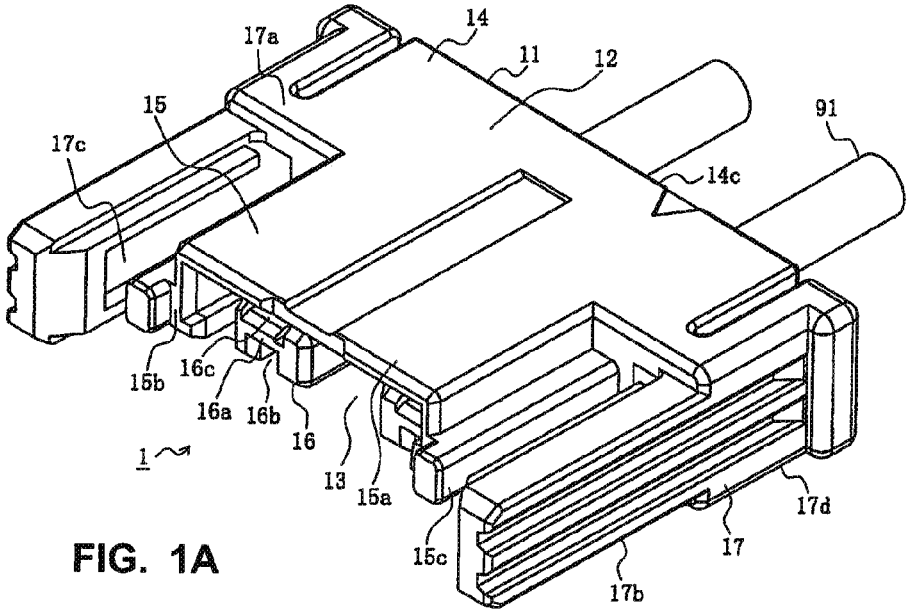
FIGS. 1A and 1B are top perspective views of a wire to board connector of the invention.
Figure 1B:
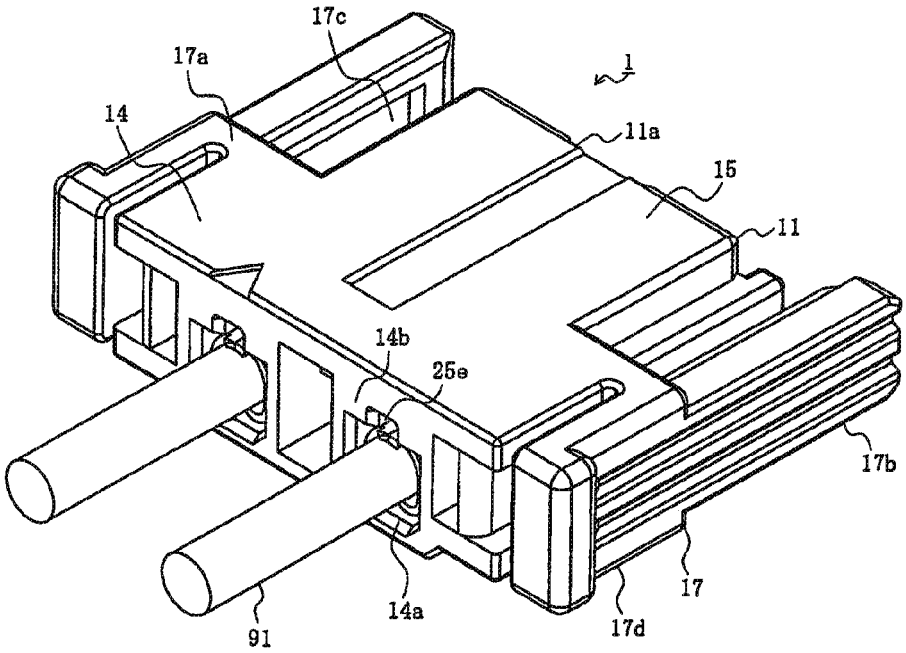

While the Present Disclosure may be susceptible to embodiment in different forms, there is shown in the Figures, and will be described herein in detail, with the understanding that the disclosure is to be considered an exemplification of the principles of the Present Disclosure, and is not intended to limit the Present Disclosure to that as illustrated. Moreover, in the Present Disclosure, directional representations—i.e., up, down, left, right, front, rear and the like, used for explaining the structure and movement of the various elements of the Present Disclosure, are relative. These representations are appropriate when the elements are in the position shown in the Figures. If the description of the position of the elements changes, however, it is assumed that these representations are to be changed accordingly.

In the drawing figures, a first connector used as a wire connector, which is one from a pair of connectors constituting a wire-to-board connector according to the present embodiment and generally designated by reference numeral 1, is a connector which is connected to a termination end of a cable that encloses a plurality of wires 91. The first connector 1 is mated to a mating second connector 101 as a counterpart connector of the pair of connectors constituting the wire-to-board connector according to the present embodiment. The second connector 101 is a surface-mounted board connector which is mounted on a surface of a circuit board 191. In drawings, although the number of wires 91 is two, the number of wires 91 may be one, or three, or more.

The wire-to-board connector includes the first connector 1 and the second connector 101, and is configured to connect the wires 91 and board 191 together. It will be described that: the wires 91 are parts of power supply lines; end portions of the electrical wires 91 opposite the first connector 1 are connected to a non-illustrated power supply; and the first connector 1 and the second connector 101 are connectors for connecting the power supply lines of the board 191. However, the wires 91 may be parts of signal lines, and the first connector 1 and the second connector 101 may be used as connectors for connecting signal lines together. Moreover, the board 191 is typically a printed circuit board used in an electronic device or apparatus and may be silicon boards or silicon carbide boards having an electronic device or apparatus arranged directly thereon or may be any type of boards. Furthermore, examples of the electronic device or apparatus include a personal computer, a cellular phone, a digital TV, a car navigation device, and a games machine and the like; however, the type of devices and apparatuses is not intended to be particularly limited.

The first connector 1 includes a first housing 11 as a housing which overall has a generally flat rectangular parallelepiped shape and is made of an insulating material such as plastic. First conductive terminals 51 are fitted in the first housing 11. In the example illustrated in the drawing figures, although the number of first terminals 51 is two assuming that the power supply lines include one positive line and one negative line, the number of first terminals 51 may be arbitrarily changed to comply with the number of power supply lines. The first terminal 51 is connected to a termination end of a wire 91.

Figure 2A:
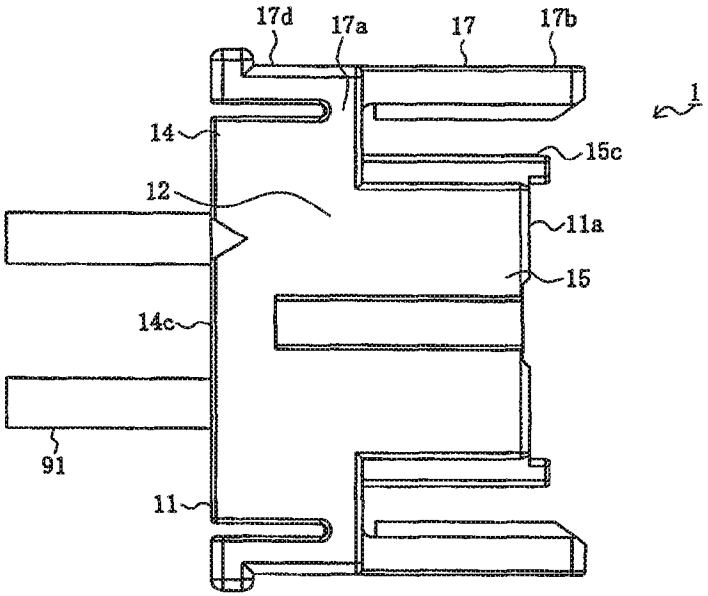
FIGS. 2A-2C are further views of the connector of FIG. 1A.
Figure 2B:
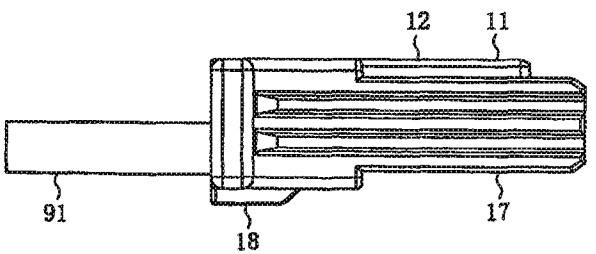
Figure 2C:
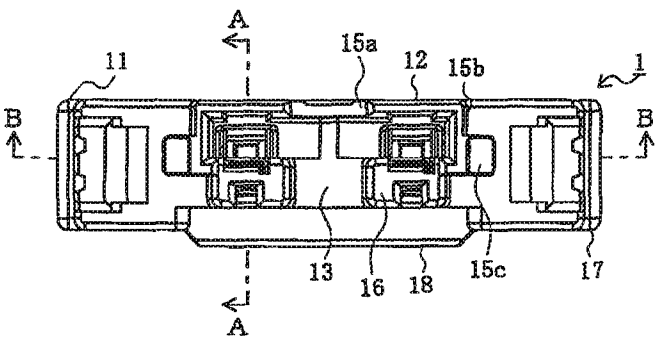

As illustrated in the drawings, the first housing 11 is provided with a first top plate portion 12 used as a top plate portion having a flat-plate shape, a first bottom plate portion 18 used as a bottom plate portion which has a flat plate shape which extends parallel to the first top plate portion 12, a first body portion 14 that has top and bottom surfaces thereof being defined by the first top and bottom plate portions 12 & 18 and holds therein the first terminals 51, and a pair of first side wall portions 17, used as side wall portions, which are arranged on opposing left and right sides of the body portion 14 and extend in the front-to-rear direction (horizontally as shown in FIGS. 2A and 2B) of the first connector 1. Moreover, a first fitting face 11*a* used as a mating, or fitting, face is configured to extend in the extending direction of the first terminals 51 and in a direction (preferably, in a direction perpendicular to) intersecting the first top plate portion 12 and the first bottom plate portion 18.

A first projecting plate portion 22 is used as a projecting plate portion and is configured to extend forwardly, and is connected to a front end of the first bottom plate portion 18. The first projecting plate portion 22 is formed to extend in the distal end direction from the upper front end of the first bottom plate portion 18 so as to cover an under part of a portion of the first terminal 51 fitted into the first housing 11 and located adjacent to the rear end of a first contacting distal end portion 55 as a contacting distal end portion, thereby functioning used as an insulating distance-procuring member capable of procuring the insulating distance of the first terminal 51.

The first body portion 14 has formed therein, on a rear end face thereof (the left end face in FIGS. 2A and 2B), first terminal-receiving-concave portions or cavities, 14*a*, which are configured to extend in the distal end direction (the rightward direction in FIGS. 2A and 2B) from the rear end face and accommodate therein the first terminals 51. In the example illustrated in the drawing figures, although the number of first terminal cavities 14*a* is two, respectively, the number of terminal receiving cavities 14*a* may be changed to comply with the number of terminals 51.

Each first side wall portion 17 is connected to one of either of the left and right side faces of the first body portion 14 via a side wall connecting portion 17*a* which is thin and flexible so as to deform about the side wall connecting portion 17*a* with respect to the first body portion 14. Portions of the first side wall portions 17 located further forward (rightward in FIGS. 2A and 2B) than the side wall connecting portion 17*a* are configured as locking arm portions 17*b*, and concave engagement portions 17*c*, which are configured to engage with later-described laterally convex portions 117*a* of the second connector 101, are formed on the inner side faces at the distal end portions of the locking arm portions 17*b*. Moreover, portions of the first side wall portions 17, which are located further rearward (leftward in FIGS. 2A and 2B) than the side wall connecting portions 17*a*, are configured as operating arm portions 17*d*. When the engagement between the first connector 1 and the second connector 101 is released, an operator operates by hand the operating arm portions 17*d* to decrease the gap between the left and right operating arm portions 17*d*. Due to this operation, the distance between the distal end portions of the locking arm portions 17*b* is increased, so that the engagement between the laterally convex portions 117*a* and the concave engagement portions 17*c* is released and the locking between the first connector 1 and the second connector 101 is released.

A first engagement portion 15 is configured to extend in distally from the first body portion 14 so as to engage with the second connector 101. The first engagement portion 15 is provided with a first engagement top plate portion 15*a* formed even with the first top plate portion 12, a pair of first engagement side wall portions 15*b* which extend along the edges of the left and right sides of the first engagement top plate portion 15*a* extending downwardly (the lower side in FIG. 2B) from the first engagement top plate portion 15*a*, and first convex engagement portions 15*c* which have a rod-like shape with a rectangular cross section and are configured to extend along the lower ends of the first engagement side wall portions 15*b*, bulge outward from the left and right end faces of the first engagement side wall portions 15*b*, and slightly protrude in the distal end direction from the front ends of the first engagement side wall portions 15*b*. In other words, the first engagement top plate portion 15*a* can be referred to as a portion of the first top plate portion 12.

A first concave engagement portion, as a concave portion, designated by reference numeral 13 is configured to be engaged with the second connector 101 and has three sides thereof being defined by the first engagement top plate portion 15*a* and the first engagement side wall portions 15*b*. In the first concave engagement portion 13, first terminal restricting portions 16 as terminal restricting members are arranged so as to extend in the distal end direction from the first body portion 14. The first terminal restricting portions 16 are generally rod-like members having a base end thereof being connected to the first body portion 14 and a distal end thereof being configured as a free end.

The distal end portion of each of the first terminal restricting portions 16 has a generally H-shape and includes a beam portion 16*a* which extends in a lateral direction, a lower groove portion 16*b* which has a rectangular cross section with an opened lower surface and is formed on the lower surface side of the beam portion 16*a*, and an upper groove portion 16*c* which has a rectangular cross section with an opened upper surface and is formed on the upper surface side of the beam portion 16*a*. The beam portions 16*a* are connected to tongue-shaped portions 16*d* which extend toward the base ends of the first terminal restricting portions 16.

Figure 5:
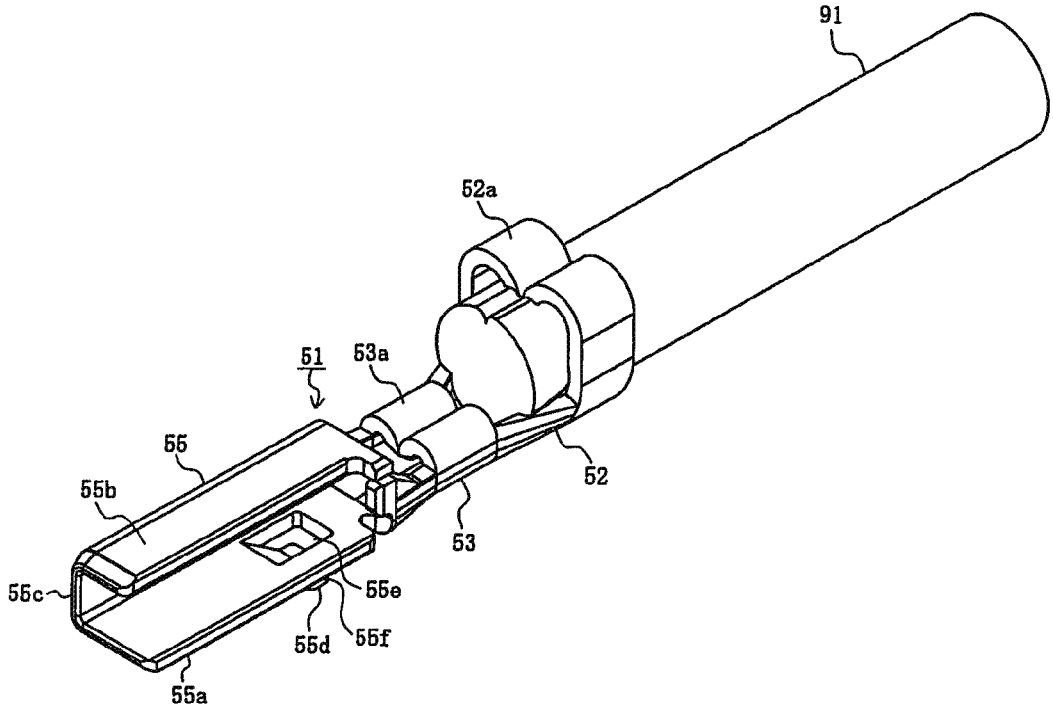
FIG. 5 is a perspective view of the first terminal terminated to a wire.
Figure 6:
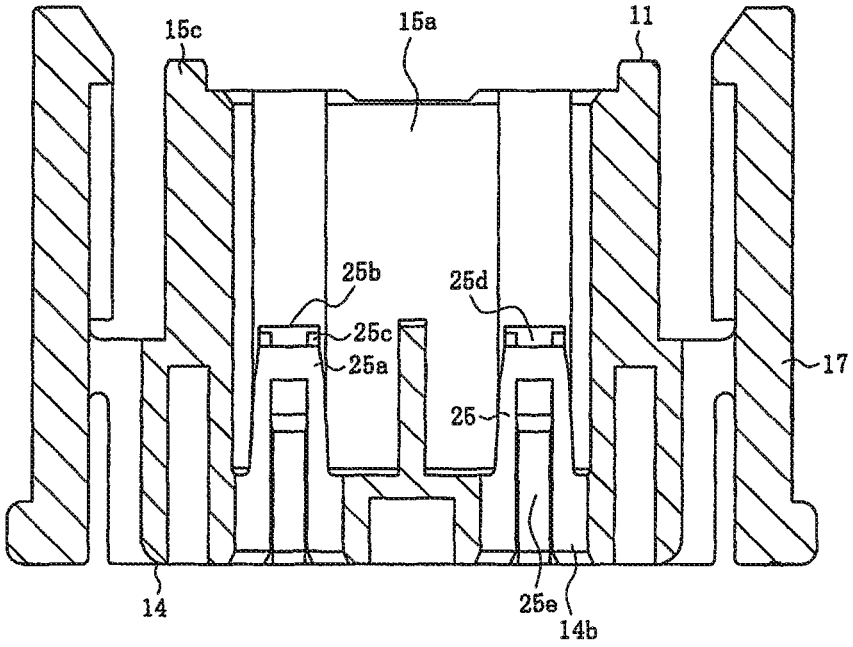
FIG. 6 is a top sectional view of the first connector of FIG. 1A, with the first terminal removed therefrom, and illustrating the same cross section as FIG. 4.
Figure 7:
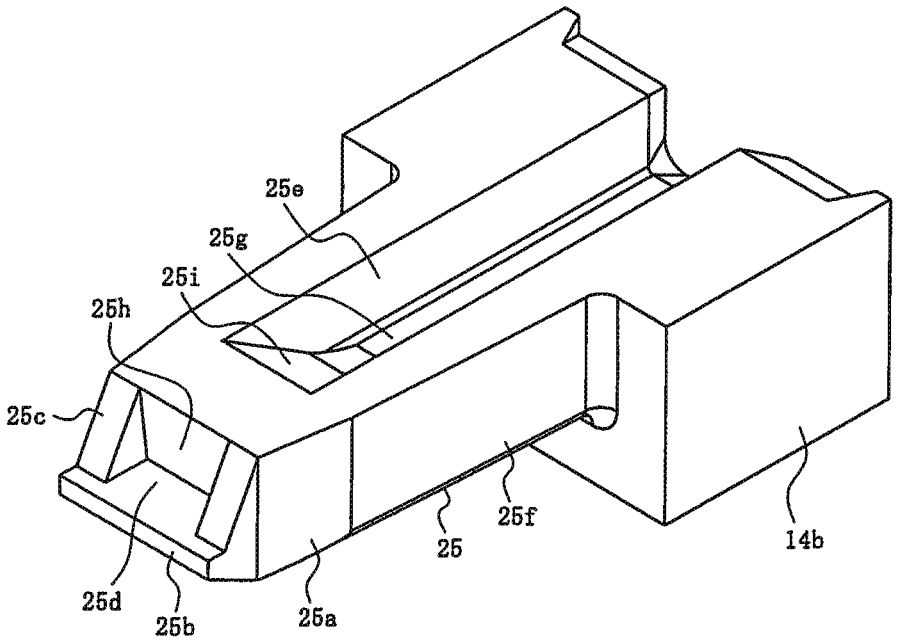
FIG. 7 is a bottom front perspective view of a locking projection portion of the connector.

The first terminals 51 may be formed by punching sheet metal or the like. As illustrated in FIG. 5, each of the first terminals 51 is provided with a conductive wire-connecting, or body portion 53, a first fixing portion 52 used as a connecting portion connected to the rear end of the wire-connecting portion 53, and a first contacting distal end portion 55 used as a first contacting arm portion which is connected to the front end of the conductive wire-connecting portion 53. The conductive wire-connecting portion 53 is a portion which is connected to a core wire used as a conductive wire of the wire 91 and is provided with a core wire-caulking portion 53*a* that caulks so as to fix the core wire. The core wire and the core wire-caulking portion 53*a* may be connected and fixed more securely by applying soldering according as is required. Moreover, the first fixing portion 52 is provided with a wire sealing portion 52*a* that seals to fix the wire 91 from the surroundings of an insulating cladding which covers the perimeter of the core wire. By sealing the wire 91 with portion 52*a*, the first terminal 51 may be firmly connected to the termination end of the wire 91.

The first contacting front end portion 55 contacts either one of the second terminals 151 in the second, or mating, connector 101. The first contacting distal end portion 55 is a channel-shaped portion having a substantially square cross-section opened at one side and extending in the distal end direction from the distal end of the first fixing portion 52. The first contacting distal end portion 55 includes a top plate portion 55*a* connected to the distal end of the first fixing portion 52, a bottom plate portion 55*b* extending parallel to the top plate portion 55*a*, and a side plate portion 55*c* which connects either the left or right lateral edges of the top plate portion 55*a* and the bottom plate portion 55*b* and extends in the same direction as the extending direction of the top plate portion 55*a* and the bottom plate portion 55*b*. Moreover, since the first contacting distal end portion 55 itself has a channel shape having a cross-section in the form of substantially squared U-shape, the first contacting distal end portion 55 has a large secondary section modulus and a high rigidity, and is therefore hardly deformed.

Figure 3:
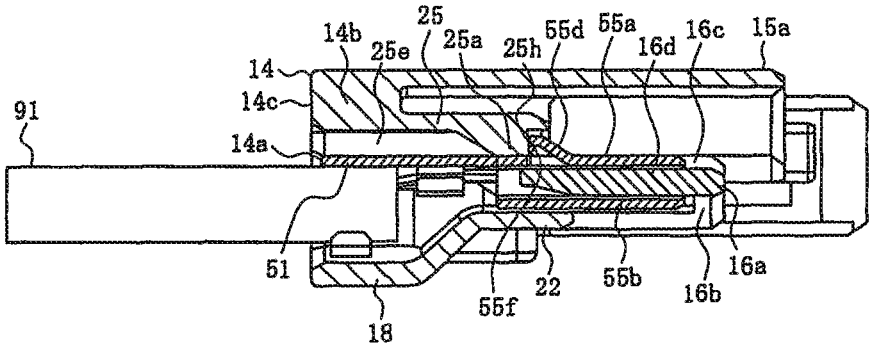
FIG. 3 is a sectional view of the connector of FIG. 2C taken along line A-A thereof.

As illustrated in FIG. 3, when the first terminals 51 are inserted into the first terminal receiving cavity 14*a* from the rear of the first body portion 14 fitted into the first housing 11, the tongue-shaped portions 16*d* of the first terminal restricting portions 16 are inserted from the side of the distal ends of the first contacting distal end portions 55 into portions disposed between the top plate portions 55*a* and the bottom plate portions 55*b* of the first contacting distal end portions 55. Due to such a configuration, the vertical displacement of the first contacting distal end portion 55 is restricted, so that the first contacting distal end portion 55 is almost impossible to be displaced in the vertical direction.

Moreover, on the top plate portion 55*a* of the first contacting distal end portion 55, a locking piece 55*d* which is a cut and raised piece is formed so as to be projected further upward (downward, as shown in FIG. 5) than the top plate portion 55*a*. The locking piece 55*d* is a cantilever-like member which has elastic properties and has a base end thereof connected to the top plate portion 55*a* and a free end thereof, namely a distal end 55*f*, configured to extend obliquely toward the upper rear side. Since the locking piece 55*d* is formed by being cut and raised, a window portion 55*e* used as an opening is defined in the top plate portion 55*a*.

Figure 4:
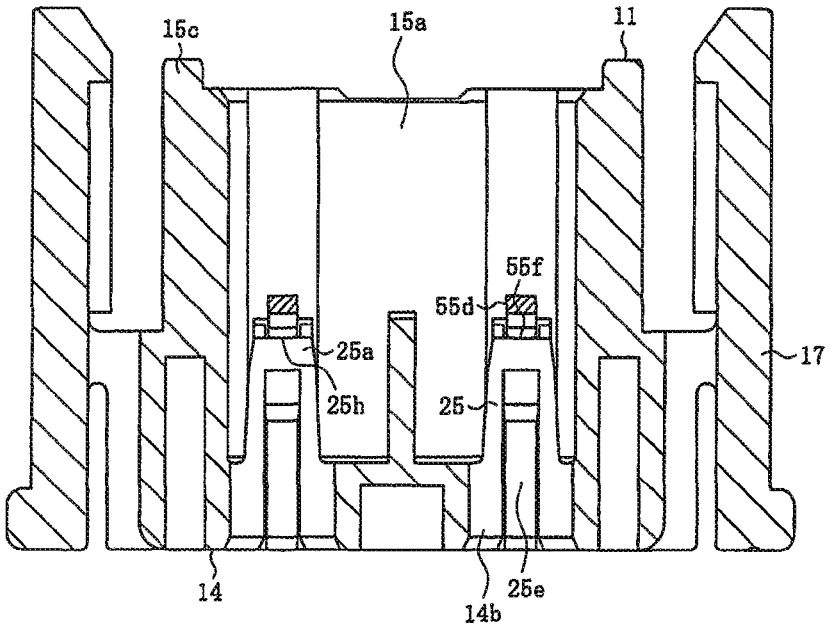
FIG. 4 is a top sectional view of the connector of FIG. 2C, taken along line B-B thereof.

The first body portion 14 is provided with a lance holding portion 14*b* as a locking projection-holding portion which is arranged above the first terminal accommodation-concave portion 14*a*, and a lance 25 used as a locking projection portion is held in the lance holding portion 14*b*. The lance 25 is a member which is formed integral with the first housing 11 so as to extend forward from the lance holding portion 14*b* with a base end thereof being connected to the lance holding portion 14*b*. The lance 25 is provided with a locking block portion 25*a* which is in mass form and is arranged at a distal end thereof, and as illustrated in FIGS. 3 and 4, the distal end 55*f* of the locking piece 55*d* is locked at the front end face 25*h* of the locking block portion 25*a*. Due to such a configuration, the first terminals 51 fitted into the first housing 11 are prevented from being removed toward the rear side.

On the lower surface of the lance 25, a groove portion 25*e* is formed at a position located further rearward than the locking block portion 25*a* so as to extend in the extending direction of the first terminal 51. The groove portion 25*e* is configured to extend to pass through the lance holding portion 14*b* opened to the rear end face 14*c* of the first body portion 14. Therefore, when the first terminal 51 is inserted to be fitted into the first terminal cavity 14*a* from the rear side of the first body portion 14, the locking piece 55*d* which is projected further upward than the top plate portion 55*a* of the first contacting distal end portion 55 passes through the groove portion 25*e*, so that the first terminal 51 can be smoothly inserted into the first terminal receiving portion 14*a*. When the first contacting distal end portion 55 is moved forward in the first terminal receiving portion 14*a* so that the locking piece 55*d* passes under the locking block portion 25*a*, the locking piece 55*d* is elastically deformed so that the distal end 55*f* is deformed downward. When the locking piece 55*d* has completely passed through, the locking piece 55*d* elastically restores its original shape, so that the distal end 55*f* is deformed upward to be locked at the front end face 25*h* of the locking block portion 25*a*. Due to such a configuration, the first terminal 51 which has been completely inserted into the first terminal cavity 14*a* will not be moved toward the rear side. Moreover, the operator is able to perceive the resistance received from the locking block portion 25*a* when the locking piece 55*d* is elastically deformed by sensing a clicking feeling. Accordingly, the operator is able to correctly become aware of and to confirm the completion of the operation of fitting the first terminals 51 into the first housing 11.

Next, the detailed description of the configuration of the lance 25 will be provided below. The lance 25 has a base end thereof being connected to the lance holding portion 14*b* and is provided with the locking block portion 25*a* which is in mass form and is arranged at the front end thereof so as to extend forward from the lance holding portion 14*b*. The groove portion 25*e* is formed on a portion of the lower surface of the lance 25 being located further rearward than the locking block portion 25*a*, and the groove portion 25*e* extends to pass through the lance holding portion 14*b* opened to the rear end face 14*c* of the first body portion 14.

Furthermore, on the front end face 25*h* of the locking block portion 25*a*, a canopy portion 25*b* used as a projection portion configured to be projected forward from an upper end of the front end face 25*h* and laterally covering portions 25*c* as projection portions configured to be projected forward from both left and right ends of the front end face 25*h* are formed to be integral with the front end face 25*h*. Moreover, a concave portion having the perimeter thereof being defined by the front end face 25*h*, the canopy portion 25*b*, and the laterally covering portions 25*c* of the locking block portion 25*a* functions as a locking piece-accommodation concave portion 25*d*, and the front end 55*f* of the locking piece 55*d* is accommodated in the locking piece-accommodation concave portion 25*d*, whereby the locking piece 55*d* is prevented from being removed from the front end face 25*h* of the locking block portion 25*a*.

The portion of the lance 25 located further rearward than the locking block portion 25*a* has a lower surface thereof having the groove portion 25*e* formed therein, so that the lance 25 is provided with the side portions 25*f* on both left and right sides thereof and the ceiling portion 25*g* which are configured to define the circumferential surfaces of the groove portion 25*e* and has a channel shape having a cross-section in the form of substantially squared U-shape. Moreover, a sloped portion 25*i* is formed on portions of the groove portion 25*e* being connected to the locking block portion 25*a*, and the lower surface of the ceiling portion 25*g* is configured to be smoothly connected to the lower surface of the locking block portion 25*a* via the lower surface of the sloped portion 25*i*. Due to such a configuration, when the first terminal 51 is inserted into the first terminal cavity 14*a* from the rear of the first body portion 14, the locking piece 55*d* can smoothly pass under the locking block portion 25*a*. Since the lance 25 has such a shape, it is possible to prevent the occurrence of weld lines at the base end of the lance 25 or the vicinity thereof.

The first housing 11 is molded by integral molding with resin, and a gate portion which is an entrance port of molten resin in a resin-molding mold is generally positioned at a position corresponding to the vicinity of the center of the first body portion 14. Therefore, the lance 25 is located at a distance from the gate portion and the end point of the flow of the molten resin. Therefore, weld lines, which are lines representing an interface which is formed because two converging flows of the molten resin are unable to reunite, are likely to occur in the lance 25.

However, the lance 25 is provided with a groove portion 25*e* formed further rearwardly than the locking block portion 25*a* and this lance has a channel shape having a cross-section in the form of substantially squared U-shape, and an underpart thereof is bifurcated to the left and the right. Therefore, it is difficult for the flows of molten resin, which are caused to flow toward the lance 25 from the lance holding portion 14*b* of the first body portion 14, to reunite from the left and the right. As a result, the weld lines, which are lines representing an interface which is formed because two converging flows of the molten resin are unable to reunite, will not occur at the base end of the lance 25 or the vicinity thereof, namely the portions thereof being connected to the lance holding portion 14*b* or the vicinity of the lance holding portion 14*b*. The weld lines do not occur at the whole portion of the lance 25 on which the groove portion 25*e* is formed.

As illustrated in FIGS. 8C to 8E, the cross-sectional area of the portion on which the groove portion 25*e* is formed is smaller than the cross-sectional area of the locking block portion 25*a* which is connected to the distal end of said portion. Therefore, since in the portion on which the groove portion 25*e* is formed, the molten resin flowing from the lance holding portion 14*b* can smoothly flow toward the distal end and the occurrence of the weld lines can be prevented more effectively. FIG. 8E is illustrating the cross section of the portion on which the sloped portion 25*i* is formed, and more strictly speaking, the approximate cross section of the locking block portion 25*a* rather than the cross section of the locking block portion 25*a* itself.

As illustrated in FIGS. 8C and 8D, in the cross section of the portion on which the groove portion 25*e* is formed, the thickness dimension of the side portion 25*f*, indicated by arrow □, is substantially equal to or larger than the thickness dimension of the ceiling portion 25*g*, indicated by arrow. Namely, the portion of the lance 25 on which the groove portion 25*e* is formed has a substantially constant thickness. Therefore, the flow of the molten resin flowing from the lance holding portion 14*b* will not be biased, and the occurrence of the weld lines can be prevented more effectively.

The groove portion 25*e* is formed to extend to pass through not only the lance 25 but also the lance holding portion 14*b*. Therefore, since the flow of the molten resin toward the lance 25 is bifurcated to the left and the right at the under part of the lance holding portion 14*b*, the occurrence of the weld lines resulting from the converging flows from the left and the right can be suppressed more effectively.

Since the sloped portion 25*i* is formed, the cross-sectional area of the sloped portion 25*i* increases gradually from the portion on which the groove portion 25*e* is formed to the locking block portion 25*a*. Therefore, since the flows of molten resin flowing toward the locking block portion 25*a* are able to reunite gradually, the occurrence of weld lines in the locking block portion 25*a* can be prevented effectively.

Since the canopy portion 25*b* and the laterally covering portions 25*c* are connected to the front end face 25*h* of the locking block portion 25*a*, the molten resin flowing toward the locking block portion 25*a* is caused to flow toward the canopy portion 25*b* and the laterally covering portions 25*c*. Therefore, the molten resin is able to flow smoothly, and the occurrence of the weld lines in the locking block portion 25*a* can be prevented more effectively.

As described above, since the lance 25 according to the present embodiment has such an appropriate shape, the occurrence of the weld lines in the lance 25 can be prevented effectively. Even when weld lines occur, they will occur in the locking block portion 25*a* which is the distal end of the lance 25 or the canopy portion 25*b* and the laterally covering portions 25*c* which are connected to the front end face 25*h* and will not occur at the base end of the lance 25 or the vicinity thereof. Therefore, even when a strong force is applied thereto from the first terminal 51 via the locking piece 55*d*, it is not likely that there will be an unfavorable state such that the whole body of the lance 25 is broken so that the first terminal 51 fitted into the first housing 11 are removed toward the rear side.

Moreover, since the portion of the lance 25 on which the groove portion 25*e* is formed has a channel shape having a cross-section in the form of substantially squared U-shape, the portion has a large secondary section modulus thereof and a high rigidity. Therefore, the lance 25 will exhibit a sufficiently high rigidity even when the groove portion 25*e* is formed therein. Even when a strong force is applied thereto from the first terminal 51 via the locking piece 55*d*, it is not likely that there will be an unfavorable state such that the whole body of the lance 25 is broken so that the first terminal 51 fitted into the first housing 11 are removed toward the rear side.

Next, the description of the structure of the second connector 101 will be provided herein below. The second connector 101 includes a second housing 111 as a female board housing which has a generally rectangular overall shape and is integrally formed of an insulating material such as synthetic resin, second terminals 151 as female board terminals which are made of metallic material and fitted in the second housing 111, and second auxiliary metallic brackets 181 as female board housing-attachment auxiliary metallic brackets which are made of metallic material and attached to the second housing 111.

As shown in the drawings, the second housing 111 is provided with a second bottom plate portion 118 as a bottom plate portion which has a generally rectangular flat-plate shape opposing the top surface of the board 191, a second body portion 114 as a body portion which is formed so as to extend along an edge on the rear side (the left end in FIGS. 10 and 11) of the second bottom plate portion 118 and upstand from the second bottom plate portion 118, thereby holding therein the second terminals 151, and a pair of second side wall portions 117, as side wall portions, which is formed so as to extend along edges on both left and right sides of the second bottom plate portion 118 and upstand from the second bottom plate portion 118. Moreover, a second fitting face 111*a* as a fitting face is configured to extend in a direction intersecting (preferably, in a direction substantially perpendicular to) the top surface of the board 191. The rear ends of the second side wall portions 117 are connected to both left and right ends of the second body portion 114, the upper surface portions of the second side wall portions 117 and the upper surface portion of the second body portion 114 are formed to be continuous and even with each other, thus constituting a second top plate portion 112 having a substantially squared U-shape. Moreover, a central concave portion designated by reference numeral 113 has a lower portion thereof being defined by the second bottom plate portion 118 and three sides thereof being defined by the second side wall portions 117 and the second body portion 114.

The second body portion 114 has formed therein, on a rear end face thereof, second terminal accommodation-concave portions or cavities 114*a* which are configured to extend in the distal end direction (the rightward direction in FIGS. 10 and 11) from the rear end face and accommodate therein the second terminals 151 and second terminal holding portions 114*b* which are arranged at positions of the second terminal CAVITIES 114*a* located between the second bottom plate portion 118 and the second top plate portion 112 so as to hold therein the second terminals 151.

Figure 9A:
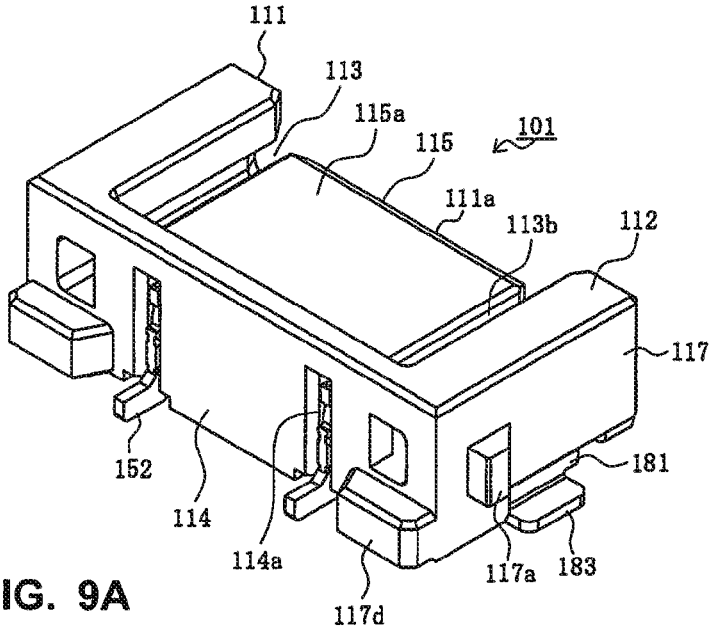
FIGS. 9A-9B are top perspective views of a board-mounted, mating connector according to the disclosure.
Figure 9B:
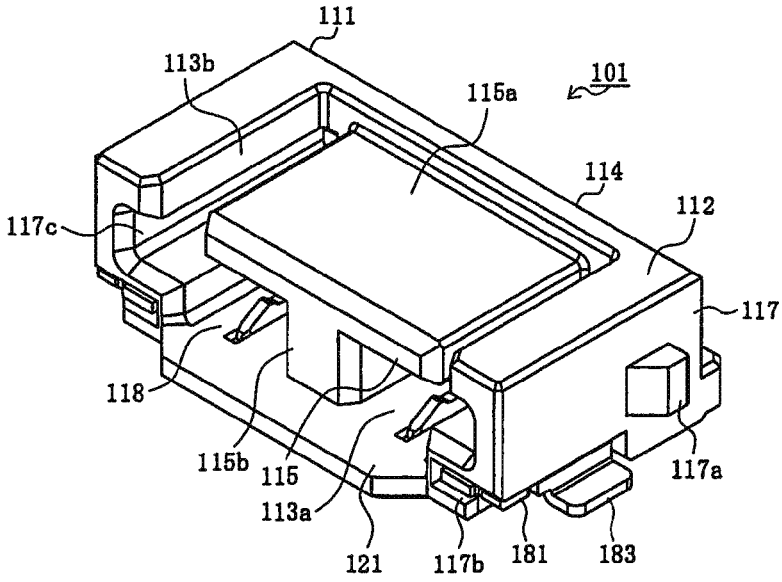
Figure 10A:
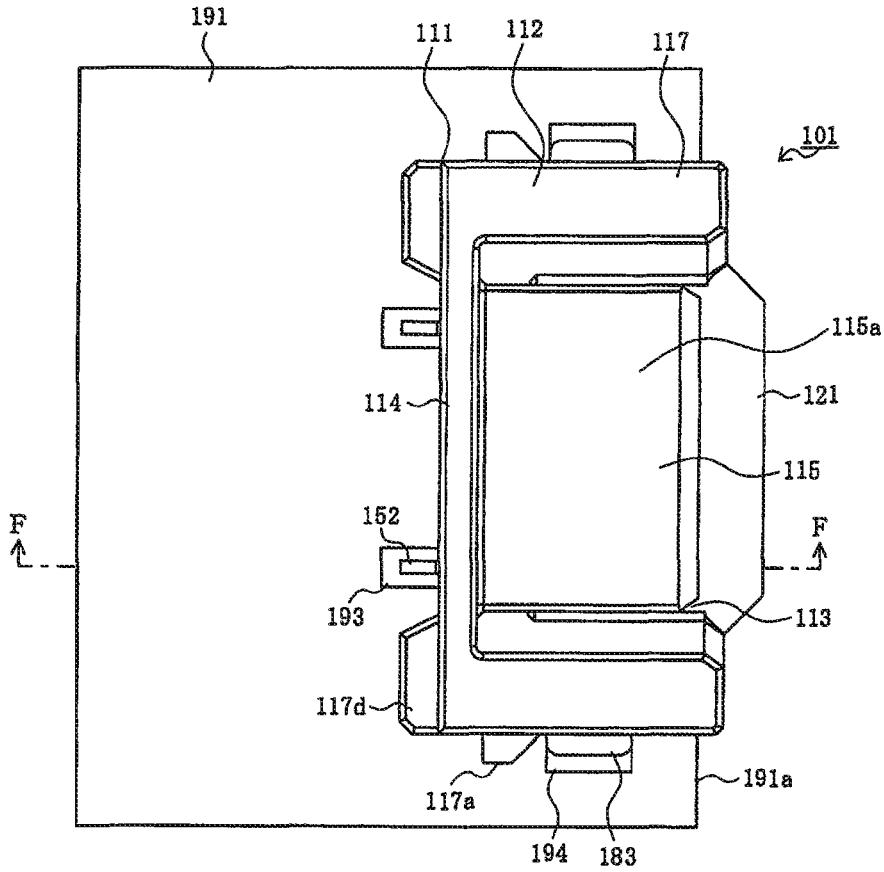
FIGS. 10A-10B are views of the connector of FIG. 9A mounted to a circuit board.
Figure 10B:
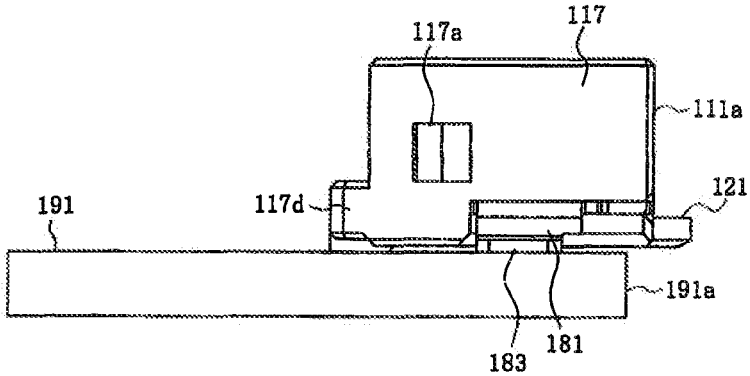

Each of the second side wall portions 117 has formed therein laterally convex portions 117*a* which are formed on side faces thereof so as to protrude laterally. Moreover, each of the second side wall portions 117 has formed therein rearwardly convex portions 117*d* which are formed on a rear face thereof so as to protrude rearward. Furthermore, each of the second side wall portions 117 has formed therein bracket holding grooves 117*b* which are formed in the vicinity of the lower end thereof so as to extend in the front-to-rear direction so that the second auxiliary metallic brackets 181 are accommodated in the bracket holding grooves 117*b*. In addition, second connecting portions 183 as connecting portions, which are formed so as to laterally protrude from the lateral ends of the second auxiliary metallic brackets 181, are fixedly secured, by soldering or the like, to second connector fixing portions 194 such as solder pads which are formed on the top surface of the board 191. In this way, the second connector 101 can be firmly secured to the board 191. As illustrated in FIGS. 9 and 10, it is preferable that the second auxiliary metallic brackets 181 and the second connecting portions 183 do not protrude rightward or leftward from the laterally convex portions 117*a* of the second side wall portions 117.

A second engagement portion 115 is arranged within the central concave portion 113 so as to be engaged with the first connector 1. The second engagement portion 115 is provided with a second engagement top plate portion 115*a* which is formed to be in parallel to the second top plate portion 112, and a second engagement support wall portion 115*b* which extends in the front-to-rear direction and supports the second engagement top plate portions 115*a*. The second engagement support wall portion 115*b* is formed so as to upstand from the second bottom plate portion 118 at the central portion in the width direction of the second bottom plate portion 118 and has its upper end to which the second engagement top plate portion 115*a* is connected.

The second engagement top plate portion 115*a* is arranged at a lower position than the second top plate portion 112 which surrounds the three sides thereof. When the first connector 1 and the second connector 101 are engaged together by fitting, the first engagement top plate portion 15*a* of the first engagement portion 15 is positioned so as to overlap the upper surface of the second engagement top plate portion 115*a* so that the upper surface of the first engagement top plate portion 15*a* becomes substantially even with the upper surface of the second top plate portion 112. The upper surface of the second engagement top plate portion 115*a* is smooth and flat and may function as a suctioned surface which is absorbed and sucked by a suction tool arranged at the distal end of a tool such as a robot hand, during assembling steps for mounting the second connector 101 on the top surface of the board 191. The absorption and suction by the suction tool is generally impossible when an uneven structure such as a scratch exists on the suction surface. However, since the upper surface of the second engagement top plate portion 115*a* in the present embodiment has its three sides thereof being surrounded by the second top plate portion 112 having a large height, the upper surface is hardly damaged by coming into contact with other members during operations such as assembly steps. Therefore, the upper surface of the second engagement top plate portion 115*a* is free of uneven structures and is thus able to reliably function as a suctioned surface.

Moreover, spaces between the second engagement top plate portion 115*a* and the second bottom plate portion 118 on both left and right sides of the second engagement support wall portion 115*b* are configured as second concave engagement portions 113*a* as concave portions which are engaged with the first connector 1. The first terminal restricting portion 16 and the first contacting distal end portion 55 of the first terminal 51 are inserted into the second concave engagement portions 113*a*. Furthermore, slit-like openings which are formed between both left and right edges of the second engagement top plate portion 115*a* and the second side wall portions 117 on the left and right sides so as to extend in the front-to-rear direction are configured as second lateral engagement concave portions 113*b* which are in communication with the second concave engagement portions 113*a*. The first engagement side wall portions 15*b* of the first engagement portion 15 are inserted into the second lateral engagement concave portions 113*b*. In addition, on the inner left and right side faces of the second side wall portions 117, second engagement groove portions 117*c* are formed, which are trenches having a rectangular cross section; opened toward the second concave engagement portions 113*a*, and extending in the front-to-rear direction. The first convex engagement portions 15*c* of the first engagement portion 15 are inserted into the second engagement groove portions 117*c*.

Figure 12:
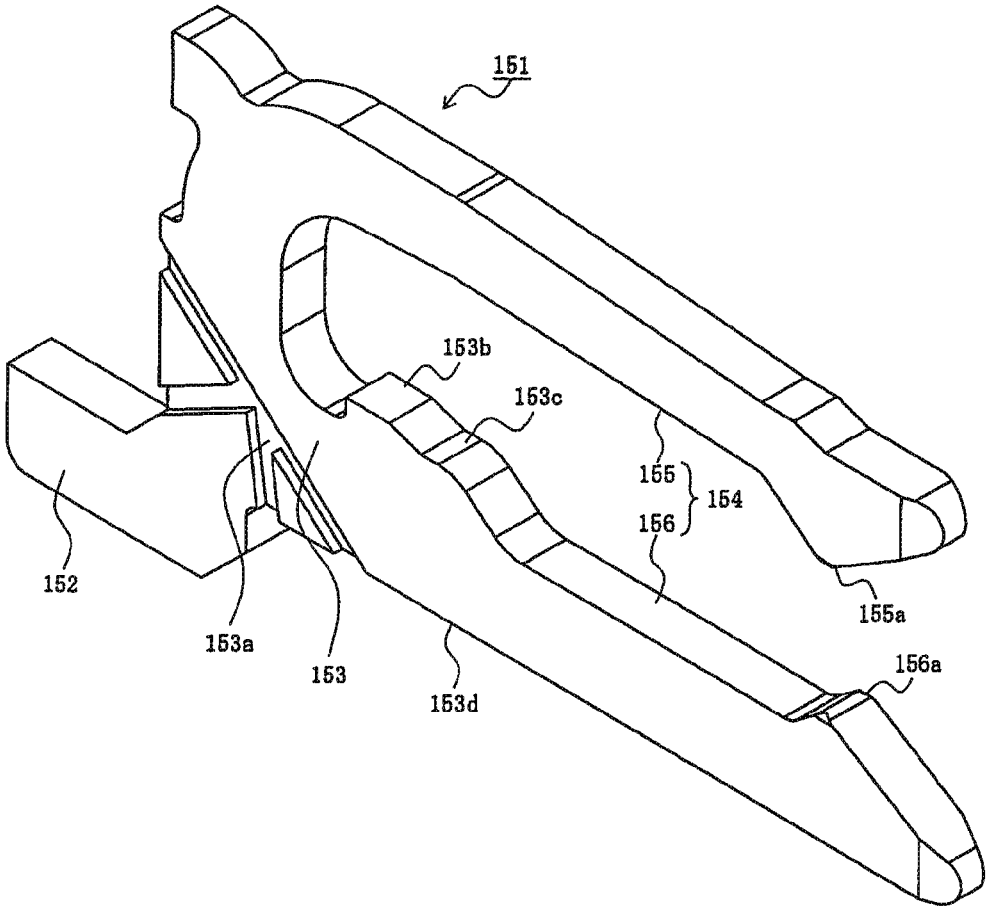
FIG. 12 is a perspective view of a terminal used in the mating connector of FIG. 9A.

The second terminals 151 according to the present embodiment are integrally formed in a bifurcated element by applying processing, e.g., punching, to a metallic plate and have a generally squared C-shaped or U-shaped side form as illustrated in FIG. 12. Each of the second terminals 151 is provided with a second fixing portion 153 as a body portion, a second tail portion 152 as a second surface connecting portion which extends rearward from the lower end of the second fixing portion 153, and a second contacting arm portion 154 which extends frontward from the second fixing portion 153.

In the second tail portion 152, a portion thereof connected to the second fixing portion 153 is accommodated in the second terminal cavity 114*a*, whereas the remaining portion thereof is exposed further rearward (Leftward, in FIGS. 10 and 11) than the rear face of the second body portion 114 from the lower end of the second terminal cavity 114*a*. The second tail portion 152 is electrically connected and secured, by soldering or the like, to a second connector electrode portion 193, such as a conductive pad, formed on the top surface of the board 191. Hence, the second terminals 151 are connected to non-illustrated conductive traces for power supply of the board 191, formed to be connected to the second connector electrode portions 193. Here, it is preferable that the second tail portion 152 does not protrude rearward from the rearwardly convex portion 117*d* of each of the second side wall portions 117 and does not protrude upward from the upper end of the rearwardly convex portion 117*d*.

The second contacting arm portion 154 is provided with a second upper contacting arm portion 155 which extends frontward from the upper end of the second fixing portion 153 and a second lower contacting arm portion 156 which extends frontward from the lower end of the second fixing portion 153. An upper contacting portion 155*a* configured to protrude downward is formed at the free end, namely in the vicinity of the distal end of the second upper contacting arm portion 155, and a lower contacting portion 156*a* configured to protrude upward is formed at the free end, namely in the vicinity of the distal end of the second lower contacting arm portion 156. The upper contacting portion 155*a* and the lower contacting portion 156*a* are portions which function as second contacting distal end portions of the second terminals 151 and come into electrical contact with the first contacting distal end portions 55 of the first terminals 51. Since at least the second upper contacting arm portion 155 of the second contacting arm portion 154 has some degree of flexibility and is thus able to elastically deform in the vertical direction, at least the upper contacting portion 155*a* is able to elastically deform in the vertical direction to some extents.

A second locking projection 153*b* configured to project upward is formed in a connecting portion of the second fixing portion 153 and the second lower contacting arm portion 156. When the second terminals 151 are press-fitted into the second terminal accommodation-concave portions 114*a*, the second locking projections 153*b* are squeezed into the lower surfaces of the second terminal holding portions 114*b* so that they are locked. Moreover, the upper end portion 153*c* and the lower end portion 153*d* of the second fixing portion 153 are pressed against the lower surface of the second terminal holding portion 114*b* and the upper surface of the second bottom plate portion 118, respectively. That is to say, the second terminals 151 are securely held in the second terminal accommodation-concave portions 114*a* when the second locking projections 153*b* are squeezed into the lower surfaces of the second terminal holding portions 114*b* and the second fixing portions 153 are pinched from the upper and lower sides by the second terminal holding portions 114*b* and the second bottom plate portion 118.

For prevention of flux creep, a plurality of groove portions 153*a* is formed on the side faces of the second fixing portion 153. When the second tail portion 152 is soldered to the second connector electrode portion 193 formed on the top surface of the board 191, a flux creep phenomenon generally occurs in which flux contained in the solders generally melts down to creep up along the surface of the second terminal 151. Since the flux has insulating properties, when the flux adheres on the surface of the second upper contacting arm portion 155 and the second lower contacting arm portion 156, it is difficult to achieve an electrical connection with the first contacting distal end portions 55 of the first terminals 51. In such a case, the flux creep mainly occurs in the side faces of the second terminals 151. Therefore, in the present embodiment, the groove portions 153*a* are formed on the side faces of the second fixing portion 153. The number, the width, the depth, the shape and the like of the groove portions 153*a* are appropriately determined in consideration of the strength or the like of the second fixing portion 153.

Figure 11:
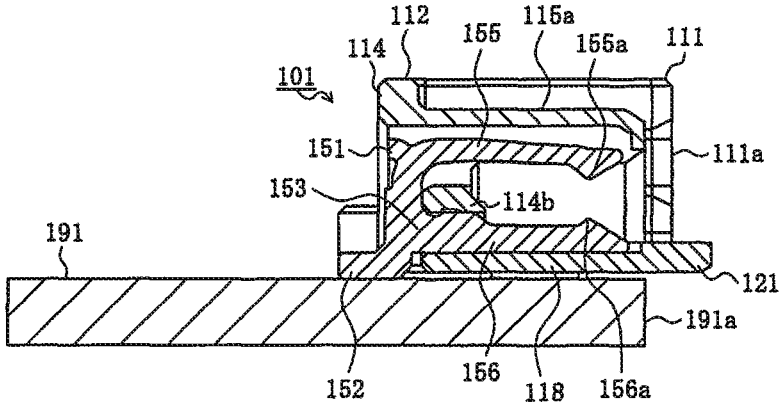
FIG. 11 is a sectional view of the mating connector of FIG. 10A, taken along line F-F thereof.

The second connector 101 is mounted on the end of the board 191 as illustrated in FIGS. 10 and 11. Although only the portions disposed in the vicinity of the end of the board 191 are illustrated the board 191 may be an rectangular shape, for example, and is larger than the illustration, and the second connector 101 is mounted on one end of its both longitudinal ends. Specifically, as illustrated in FIG. 11, the second connector 101 is mounted at such a position that the second fitting face 111*a* protrudes outward from an end face 191*a* of the board 191 and that the front end of the second bottom plate portion 118 of the second housing 111 becomes substantially identical with the end face 191*a* which is one of both longitudinal ends of the board 191. It should be noted that the front end of the second bottom plate portion 118 is not necessary perfectly even with the end face 191*a* of the board 191; however, it is preferable that the distance between the front end of the second bottom plate portion 118 and the end face 191*a* of the board 191 is short, as illustrated in FIG. 11.

The front end of the second bottom plate portion 118 is connected to a second projecting plate portion 121 as a projecting plate portion which is configured to extend frontward. The second projecting plate portion 121 is formed to extend in the distal end direction from the front end of the second bottom plate portion 118 so as to protrude frontward from the front end of the second engagement portion 115 as illustrated in FIG. 9B.

When a conductive member such as a conductive casing, a conductive plate for electromagnetic shielding or the like is arranged on the rear side of the board 191, the second projecting plate portion 121 functions as an insulating distance-procuring portion. Since the conductive member functions as the ground at zero electric potential, potential difference may occur between the second terminal 151 and the conductive member. If the second projecting plate portion 121 is omitted, the insulating distance between a portion of the conductive member arranged on the rear side of the board 191, and located closer to the front side than the end face 191*a* and the distal end of the second lower contacting arm portion 156 will be shortened. However, in the present embodiment, since the second projecting plate portion 121 protrudes frontward from the distal end of the second lower contacting arm portion 156 in the lower portion of the second lower contacting arm portion 156, both the clearance and the creepage distance between the conductive member and the distal end of the second lower contacting arm portion 156 can be sufficiently lengthened, and thus, a sufficient insulating distance can be procured. Moreover, when the first connector 1 and the second connector 101 are engaged together by fitting, since a portion of the first contacting distal end portions 55 of each of the first terminals 51 will also have its lower portion covered by the second projecting plate portion 121, the insulating distance between the conductive member and the first contacting arm portion 54 of each of the first terminals 51 can be secured by the second projecting plate portion 121.

Next, the description of an operation of fitting the first connector 1 and the second connector 101 having the above-described structures to be engaged together will be provided. Here, the first connector 1 is connected to the termination ends of the electrical wires 91 of the first terminals 51 to be connected to the termination end of the cable having the wires 91. The second connector 101 is surface-mounted on the board 191 in a state where the second tail portions 152 of the second terminals 151 are connected, by soldering or the like, to the second connector electrode portions 193 formed on the top surface of the board 191, and that the second connecting portions 183 of the second auxiliary metallic brackets 181 are connected, by soldering or the like, to the second connector fixing portions 194 formed on the top surface of the board 191.

Figure 13A:
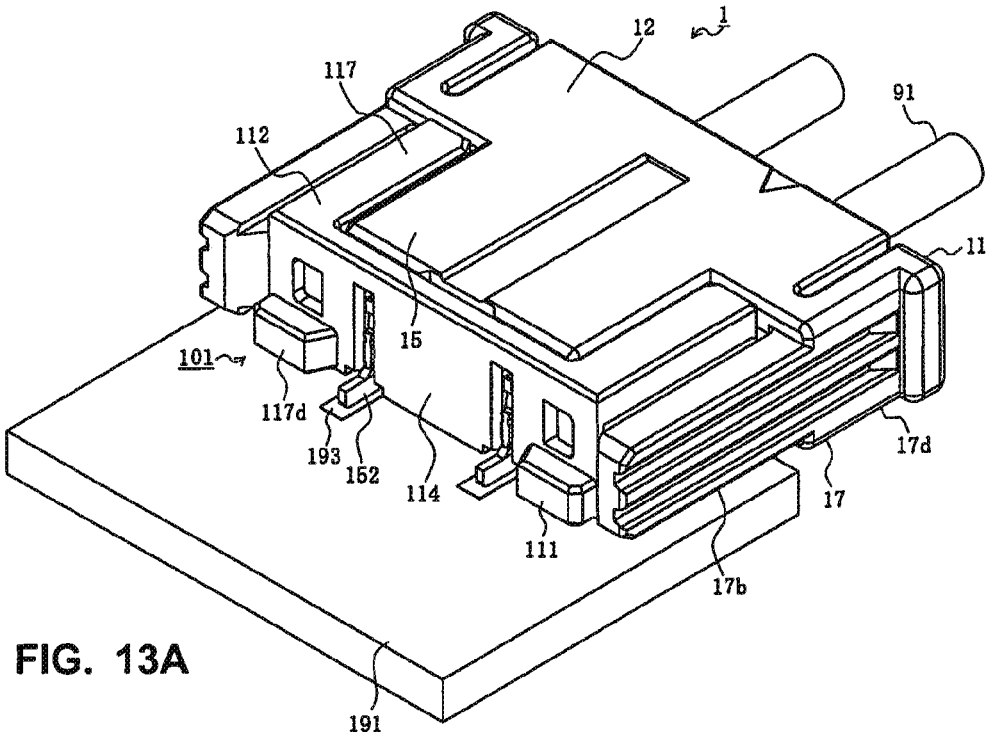
FIGS. 13A-13B are view of the connectors of FIGS. 1A and 9A, mated together.
Figure 13B:
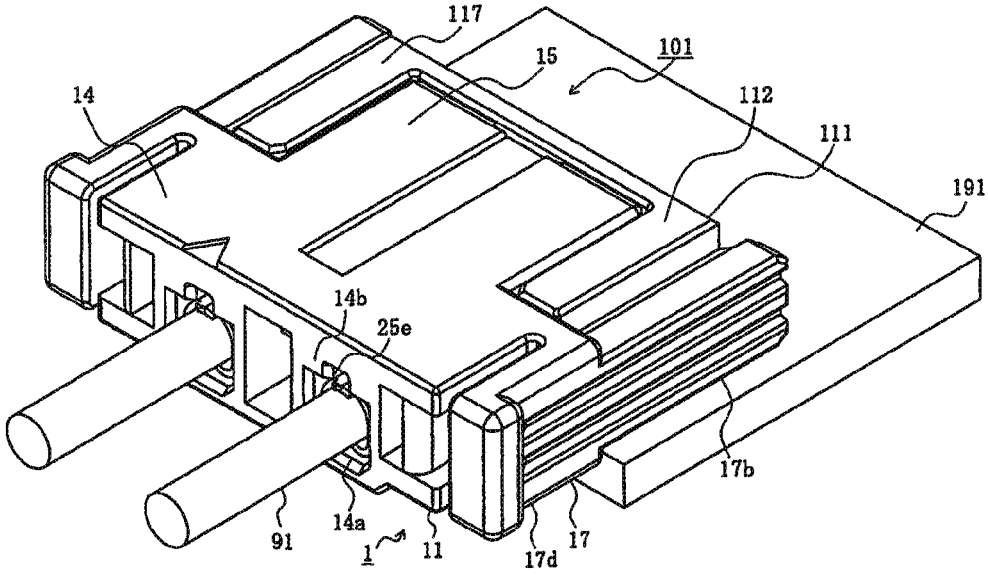
Figure 14:
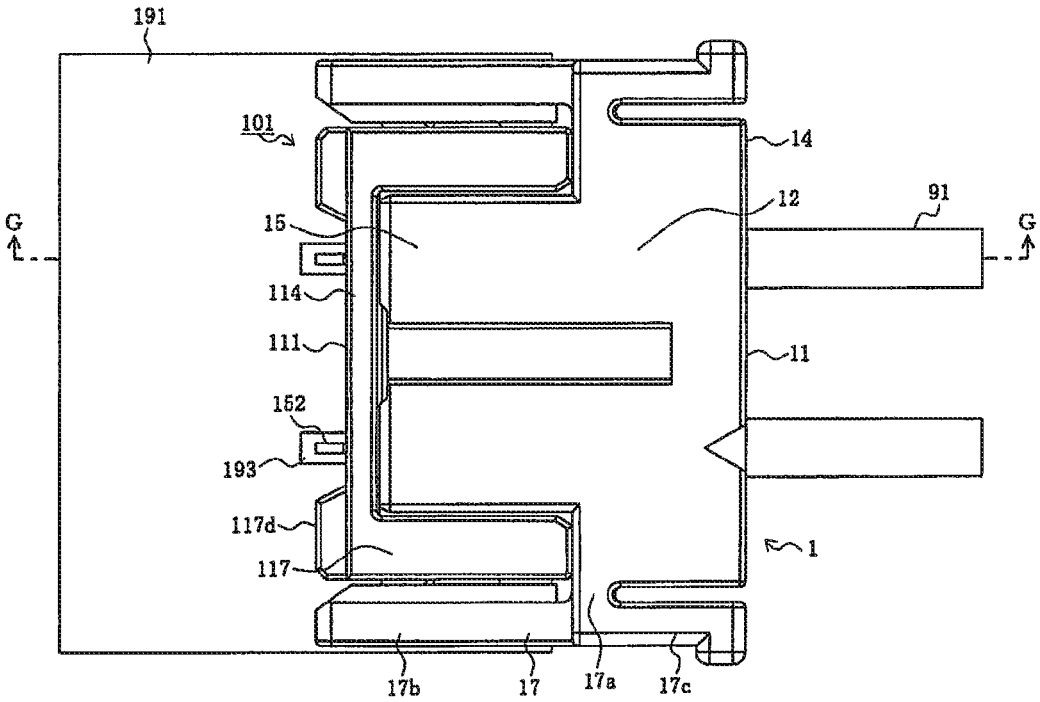
FIG. 14 is a top plan view of the connectors of FIG. 9A.

Then, an operator moves the first connector 1 and/or the second connector 101 toward either one of the connectors in a state where the first fitting face 11*a* of the first connector 1 opposes the second fitting face 111*a* of the second connector 101 so that the first terminal restricting portions 16 and the first contacting distal end portions 55 of the first terminals 51 of the first connector 1 are inserted into the second concave engagement portions 113*a* of the second connector 101. Moreover, the first engagement side wall portions 15*b* of the first engagement portion 15 of the first connector 1 are inserted into the second lateral engagement concave portions 113*b* of the second connector 101. Furthermore, the first convex engagement portions 15*c* of the first engagement portion 15 of the first connector 1 are inserted into the second engagement groove portions 117*c* of the second connector 101. In this way, the first connector 1 and the second connector 101 are engaged together as illustrated in FIGS. 13 to 15.

Figure 15:
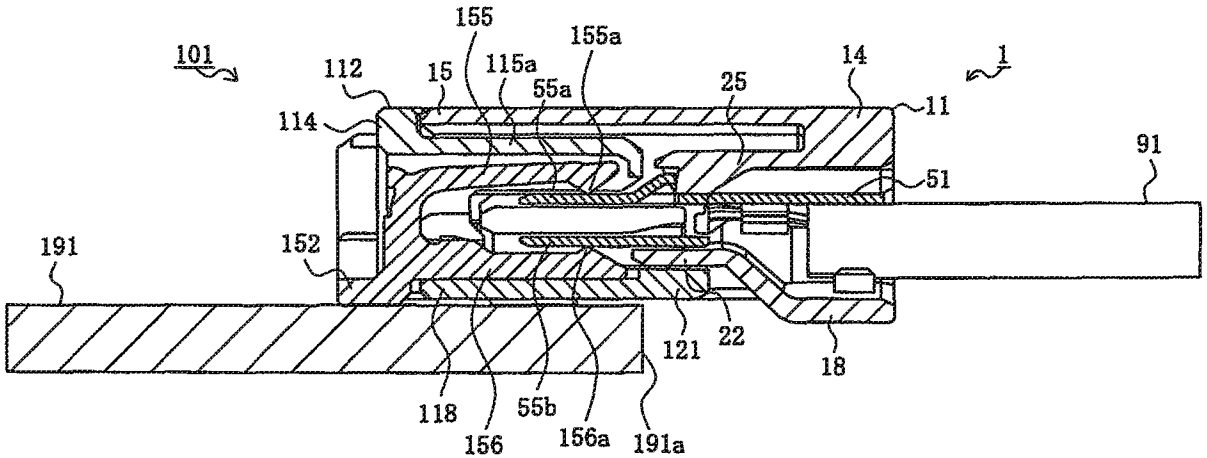
FIG. 15 is a sectional view of FIG. 14, taken along line G-G.
Figure 16:
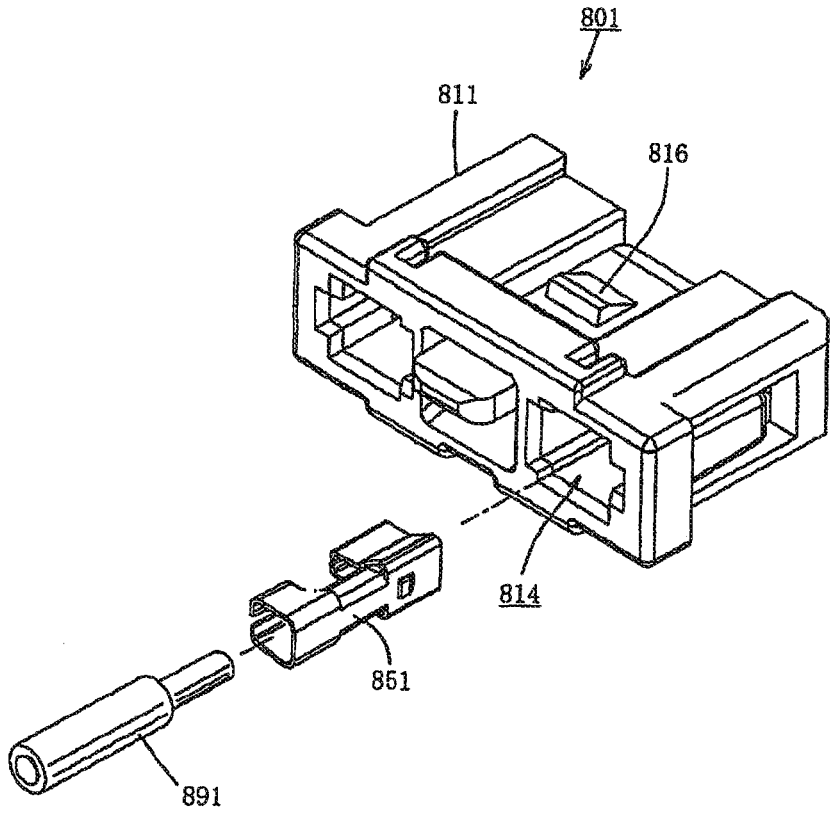
Prior art FIG. 16
FIG. 16 is an exploded perspective view of a conventional wire connector.

At this time, as illustrated in FIG. 15, the first contacting distal end portions 55 of the first terminals 51 of the first connector 1 come to be positioned between the upper contacting portions 155*a* and the lower contacting portions 156*a* of the second terminals 151 of the second connector 101. Moreover, the upper contacting portions 155*a* and the lower contacting portions 156*a* of the second terminals 151 come into contact with the top plate portion 55*a* and the bottom plate portion 55*b* of the first contacting distal end portions 55. In this way, the first terminals 51 and the second terminals 151 are electrically connected to each other. As a result, the electrical wire 91 connected to the first terminals 51 are electrically connected to the conductive traces connected to the second connector electrode portions 193 on the board 191 being connected to the second tail portions 152 of the second terminals 151.

When the first contacting distal end portions 55 of the first terminals 51 come to be positioned between the upper contacting portions 155*a* and the lower contacting portions 156*a* of the second terminals 151, the distance between the upper contacting portions 155*a* and the lower contacting portions 156*a* is increased. In this case, the second upper contacting arm portions 155 are elastically deformed vertically, so that the upper contacting portions 155*a* are elastically displaced upwardly, thereby increasing the distance between the upper contacting portions 155*a* and the lower contacting portion 156*a*. Therefore, the operator is able to perceive, by a sense of click-feeling, the resistance that the first contacting distal end portions 55 of the first terminals 51 receive when the upper contacting portions 155*a* are elastically displaced upwardly. Accordingly, the operator is able to correctly become aware of and to confirm completion of the operation of electrically connecting the first terminals 51 and the second terminals 151 so that the first connector 1 and the second connector 101 are engaged together. Moreover, since the first contacting distal end portions 55 of the first terminals 51 are elastically grasped from the upper and lower sides by the upper contacting portions 155*a* and the lower contacting portions 156*a* of the second terminals 151, it is possible to certainly maintain stable contact between the first contacting distal end portions 55 and the upper contacting portions 155*a* and the lower contacting portions 156*a*.

When the engagement between the first connector 1 and the second connector 101 is completed, as illustrated in FIG. 15, the second projecting plate portion 121 of the second housing 111 covers the entire lower surface of the first projecting plate portion 22 of the first housing 11. Therefore, a portion disposed right above the end face 191*a* of the board 191 is covered by the first projecting plate portion 22 and the second projecting plate portion 121 which overlap with each other.

As described above, when a conductive member such as a conductive casing, a conductive plate for electromagnetic shielding, a metal plate for fixation, radiation, or reinforcement, another printed circuit board, another wiring component, or a fixing bracket is arranged on the rear side of the board 191, since the conductive member functions as the ground at zero electric potential, if the first projecting plate portion 22 and the second projecting plate portion 121 do not appear, the insulating distance between the conductive member disposed under the end face 191*a* of the board 191 and the first terminals 51 and/or the second terminals 151 will be shortened. As will be easily understood from FIG. 15, particularly, the insulating distance between the conductive member and the bottom plate portions 55*b* of the first contacting distal end portions 55 of the first terminals 51 and/or the distal ends of the second lower contacting arm portions 156 of the second terminals 151 will also be shortened.

However, in the present embodiment, the first projecting plate portion 22 and the second projecting plate portion 121 which overlap with each other cover the portion disposed right above the end face 191*a* of the board 191. Therefore, both the spatial distance and the creepage distance between the conductive member and the bottom plate portions 55*b* of the first contacting distal end portions 55 of the first terminals 51 and/or the distal ends of the second lower contacting arm portions 156 of the second terminals 151 can be sufficiently lengthened, and thus, a sufficient insulating distance can be procured.

For example, as will be obvious from the example illustrated in FIG. 15, the above-mentioned creepage distance can be sufficiently long by virtue of the fact that it is approximately identical to the total sum of the distances of paths: including a path extending from the lower end to the upper end of the board 91 along its end face 191*a*; a path extending from the base end to the distal end of the second projecting plate portion 121 along its lower surface; and a path extending from the base end to the distal end of the first projecting plate portion 22 along its lower surface (or a path extending from the distal end to the base end of the second projecting plate portion 121 along its upper surface).

Therefore, it is possible to certainly prevent occurrence of any short-circuit accidents between the conductive member and the first terminals 51 and/or the second terminals 151. In the example illustrated in the drawing figures, only the first contacting distal end portion 55 of each of the first terminals 51 are positioned right above the end face 191*a* of the board 191. However, the second upper contacting arm portion 155 or the second lower contacting arm portion 156 of each of the second terminals 151 may be positioned right above the end face 191*a* of the board 191. Moreover, either one of the first projecting plate portion 22 or the second projecting plate portion 121 may be omitted as required.

When the engagement between the first connector 1 and the second connector 101 is completed, the first engagement side wall portions 15*b* of the first engagement portion 15 of the first housing 11 come into the second lateral engagement concave portions 113*b* of the second housing 111. Moreover, the first convex engagement portions 15*c* of the first engagement portion 15 of the first housing 11 come into the second engagement groove portions 117*c* of the second housing 111, and the first engagement top plate portion 15*a* of the first engagement portion 15 of the first housing 11 comes into the central concave portion 113 of the second housing 111. Furthermore, the first engagement top plate portion 15*a* overlaps the upper surface of the second engagement top plate portion 115*a* of the second housing 111.

The concave engagement portions 17*c* of the first connector 1 which are formed on the inner side faces of the front end portion of the locking arm portion 17*b* are engaged with the laterally convex portions 117*a* of the second connector 101 which are formed on the side faces of the second side wall portions 117, whereby the first connector 1 and the second connector 101 are locked.

Due to the described configuration, the first housing 11 and the second housing 111 can be firmly engaged together, and accordingly, the engagement between the first connector 1 and the second connector 101 is not released even when the relative positional relationship between the first connector 1 and the second connector 101 changes. Moreover, even when the electrical wires 91 are pulled or the electrical wires 91 are subjected to a shaking motion, the engagement between the first connector 1 and the second connector 101 will not be released.

Furthermore, since the distal end 55*f* of the locking piece 55*d* of the first terminal 51 is locked at the front end face 25*h* of the lance 25, the first terminal 51 fitted into the first housing 11 will not be removed toward the rear side even when the electrical wire 91 is subjected to a shaking or flapping motion.

As described above, in the present embodiment, the wire-to-board connector includes the first connector 1 having the first housing 11 made of an insulating material and the first terminal 51 connected to the termination end of the electrical wire 91 to be fitted in the first housing 11, the first connector 1 having the first fitting face 11*a* extended in a direction (preferably, in a direction substantially perpendicular to and) intersecting the extending direction of the first terminal 51; and the second connector 101 having the second housing 111 made of an insulating material and the second terminal 151 fitted in the second housing 111 and configured to make contact with the first terminal 51, the second connector 101 being configured to be surface-mounted on the top surface of the board 191 to be engaged with the first connector 1 and having the second fitting face 111*a* extended in a direction (preferably, in a direction substantially perpendicular to and) intersecting the top surface of the board 191. The first housing 11 is provided with the first terminal accommodation-concave portion 14*a* which is configured to be opened to the rear end face 14*c* opposing the first fitting face 11*a* and the lance 25 which is arranged in the first terminal accommodation-concave portion 14*a* and is formed therein with the groove portion 25*e* extended in the extending direction of the first terminal 51. The first terminal 51 is provided with the first contacting distal end portion 55 configured to make contact with the second terminal 151 and the locking piece 55*d* which is formed on the first contacting front end portion 55 and configured to be locked at the front end face 25*h* of the lance 25, where the first terminal 51 is inserted to be fitted into the first terminal accommodation-concave portion 14*a* from the side of the rear end face 14*c*.

Due to such a configuration, it is possible to prevent the occurrence of weld lines at the base end of the lance 25 or the vicinity thereof. As a result, it is made possible to stably hold the first terminal 51 to be firmly secured to the first housing 11 while reliably preventing the removal of the first terminal 51, thereby realizing a simple structure, a low height, and miniaturization of a wire-to-board connector and a wire connector. Accordingly, it is possible to provide a wire-to-board connector and a wire connector which can be easily produced to have a simple structure with a small number of parts and low production costs.

Moreover, the lance 25 has the base end thereof which is connected to the first body portion 14 of the first housing 11 and extended in the direction of the first fitting face 11*a*, and has the front end thereof having the locking block portion 25*a* formed thereon, the groove portion 25*e* being formed on a surface of the lance 25 located further rearward than the locking block portion 25*a*, where the lance 25 has a channel shape having a cross-section in the form of substantially squared U-shape. Due to such a configuration, weld lines will not occur in the portion of the lance 25 on which the groove portion 25*e* is formed, and the lance 25 has a large secondary section modulus and a high rigidity, and will not be broken.

Furthermore, the groove portion 25*e* is configured to be extended to pass through the first body portion 14 to be opened to the rear end face 14*c*. Due to such a configuration, the occurrence of weld lines can be prevented more effectively.

Furthermore, the lance 25 is provided with the ceiling portion 25*g* and side portions 25*f* on both left and right sides thereof, the ceiling portion 25*g* and the side portions 25*f* being configured to define the circumferential surfaces of the groove portion 25*e*, the thickness dimension of each of the side portions 25*f* being designed to be equal to or larger than the thickness dimension of the ceiling portion 25*g*. Due to such a configuration, the occurrence of weld lines can be prevented more effectively.

Furthermore, the sloped portion 25*i* is formed on portions of the groove portion 25*e* being connected to the locking block portion 25*a* so that the cross-sectional area of the sloped portion 25*i* increases gradually from the groove portion 25*e* to the locking block portion 25*a*. Due to such a configuration, the occurrence of weld lines in the locking block portion 25*a* can be prevented effectively.

Moreover, the first housing 11 is provided with the first bottom plate portion 18 configured to be extended in the extending direction of the first terminals 51, the second housing 111 is provided with the second bottom plate portion 118 configured to oppose the top surface of the board 191, and the projecting plate portion, which is configured to procure the insulating distance between the first terminals 51 or the second terminals 151, is extended from the front end of the first bottom plate portion 18 or the second bottom plate portion 118. Due to such a configuration, since the under parts of the first terminals 51 or the second terminals 151 are covered by the projecting plate portion, it is possible to procure a sufficient insulating distance between the conductive member and the first terminals 51 or the second terminals 151.

Furthermore, when the first connector 1 and the second connector 101 are engaged together, a portion of each of the first terminals 51 or the second terminals 151 is positioned right above the portion which is disposed between the front end of the first bottom plate portion 18 and the front end of the second bottom plate portion 118, and the projecting plate portion covers the lower portion of the portion of each of the first terminals 51 or the second terminals 151 disposed right above the portion between the front end of the first bottom plate portion 18 and the front end of the second bottom plate portion 118. Due to such a configuration, even when a conductive member is present between the front end of the first bottom plate portion 18 and the front end of the second bottom plate portion 118, it is possible to secure a sufficient insulating distance between the conductive member and the first terminals 51 or the second terminals 151.

While a preferred embodiment of the Present Disclosure is shown and described, it is envisioned that those skilled in the art may devise various modifications without departing from the spirit and scope of the foregoing Description and the appended Claims.

What is claimed is:

1. A wire-to-board connector comprising:

a first connector, the first connector including a first housing made of an insulating material and a first terminal connected to a termination end of an electrical wire fitted in the first housing, the first connector including a fitting face thereof extended in a direction intersecting an extending direction of the first terminal; and a second connector, the second connector including a second housing made of an insulating material and a second terminal therein and configured to make contact with the first terminal, the second connector being surface-mounted on a top surface of a board engaged with the first connector and including a fitting face thereof extended in a direction intersecting the top surface;

wherein:

the first housing includes a first terminal accommodation-concave portion, configured to be opened to a rear end face opposing the fitting face, and a locking projection portion, arranged in the first terminal accommodation-concave portion and formed with a groove portion, the groove portion extending from the first terminal accommodation-concave portion and continuing in the extending direction of the first terminal; and the first terminal includes a first contacting distal end portion, configured to contact the second terminal, and a locking piece, formed on the first contacting distal end portion and configured to be locked at a front end face of the locking projection portion where the first terminal is inserted into the first terminal accommodation-concave portion from the side of the rear end face.

2. The wire-to-board connector according to claim 1, wherein the locking projection portion includes a base end thereof connected to a first body portion of the first housing and extended in the direction of the fitting face.

3. The wire-to-board connector according to claim 2, wherein the locking projection portion further includes a distal end thereof having a locking block portion formed thereon.

4. The wire-to-board connector according to claim 3, wherein the groove portion is formed on a surface of the locking projection portion located further rearward than the locking block portion.

5. The wire-to-board connector according to claim 4, wherein the locking projection portion has a channel shape having a substantially squared U-shaped cross-section.

6. The wire-to-board connector according to claim 5, wherein the locking projection portion further includes a ceiling portion and side portions on both left and right sides thereof.

7. The wire-to-board connector according to claim 6, wherein the ceiling portion and the side portions are configured to define the circumferential surfaces of the groove portion.

8. The wire-to-board connector according to claim 7, wherein a thickness dimension of each side portion is equal to or larger than a thickness dimension of the ceiling portion.

9. The wire-to-board connector according to claim 8, wherein a sloped portion is formed on portions of the groove portion being connected to the locking block portion so that a cross-sectional area of the sloped portion increases gradually from the groove portion to the locking block portion.

10. The wire-to-board connector according to claim 5, wherein the groove portion extends through the first body portion and opens to the rear end face.

11. The wire-to-board connector according to claim 10, wherein the locking projection portion further includes a ceiling portion and side portions on both left and right sides thereof.

12. The wire-to-board connector according to claim 11, wherein a sloped portion is formed on portions of the groove portion being connected to the locking block portion so that a cross-sectional area of the sloped portion increases gradually from the groove portion to the locking block portion.

13. The wire-to-board connector according to claim 11, wherein the ceiling portion and the side portions are configured to define the circumferential surfaces of the groove portion.

14. The wire-to-board connector according to claim 13, wherein a thickness dimension of each side portion is equal to or larger than a thickness dimension of the ceiling portion.

15. A wire connector comprising:

a housing, the housing being made of an insulating material; and a terminal, the terminal being connected to a termination end of an electrical wire fitted in the housing, the wire connector including a fitting face thereof extended in a direction intersecting an extending direction of the terminal;

wherein:

the housing includes a terminal accommodation-concave portion, configured to be opened to a rear end face opposing the fitting face, and a locking projection portion, arranged in the terminal accommodation-concave portion and formed with a groove portion, the groove portion extending from the first terminal accommodation-concave portion and continuing in the extending direction of the terminal; and the terminal includes a contacting distal end portion, configured to contact a counterpart terminal, and a locking piece, formed on the contacting distal end portion and configured to be locked at a front end face of the locking projection portion where the terminal is inserted into the terminal accommodation-concave portion from the side of the rear end face.

16. The wire connector according to claim 15, wherein the locking projection portion includes a base end thereof connected to a first body portion of the first housing and extended in the direction of the fitting face.

17. The wire connector according to claim 16, wherein the locking projection portion further includes a distal end thereof having a locking block portion formed thereon.

18. The wire connector according to claim 17, wherein the groove portion is formed on a surface of the locking projection portion located further rearward than the locking block portion.

19. The wire connector according to claim 18, wherein the locking projection portion has a channel shape having a substantially squared U-shaped cross-section.

* * * * *